US005842893A

United States Patent [19]

De Keyser

[11] Patent Number: 5,842,893

[45] Date of Patent: Dec. 1, 1998

[54] ELECTRICAL CONNECTOR FOR CONNECTING ELECTRICAL CONDUCTORS

[75] Inventor: Marcel L. De Keyser, Barcelona, Spain

[73] Assignee: Framatome Connectors International, Courbevoie, France

[21] Appl. No.: 859,001

[22] Filed: May 16, 1997

[30] Foreign Application Priority Data

May 31, 1996 [ES] Spain ..... 9601203

[51] Int. Cl.[6] ..... H01R 4/50

[52] U.S. Cl. ..... 439/783; 439/393

[58] Field of Search ..... 439/783, 393, 439/417, 413, 435

[56] References Cited

U.S. PATENT DOCUMENTS

| | | | |
|---|---|---|---|
| 3,123,662 | 3/1964 | Fink | 439/393 |
| 3,188,380 | 6/1965 | Lorenz | 439/393 |
| 3,848,956 | 11/1974 | Kraft | 439/785 |

FOREIGN PATENT DOCUMENTS

| | | |
|---|---|---|
| 649835 | 1/1993 | Australia . |
| 1465220 | 12/1968 | Germany . |
| 2272799 | 5/1994 | United Kingdom . |

*Primary Examiner*—Steven L. Stephan
*Assistant Examiner*—T. C. Patel
*Attorney, Agent, or Firm*—Perman & Green, LLP

[57] ABSTRACT

Electrical connector for connecting electrical conductors having insulating covering (14), which comprises: a receiver element (2) with edges (9) in the shape of an acute angle and with wings (10) to partially enclose the conductors (12); a wedge element (6) with active edges (28) with an equal acute angle and which can be inserted between edges (9) of element (2); and an intermediate member (4) made of an electrically conductive material; suitable for being situated between receiver (2) and wedge (6) and provided with two edges (18) that form an equal acute angle; in edges (18) there are individual wings (20) between which wedge (6) can be inserted; these wings (20) have perforating means (22) suitable for piercing conductors (12) by perforating covering (14).

6 Claims, 2 Drawing Sheets

ELECTRICAL CONNECTOR FOR CONNECTING ELECTRICAL CONDUCTORS

BACKGROUND OF THE INVENTION

The invention pertains to an electrical connector for connecting electrical conductors provided with an insulating covering, said connector being suitable for being mounted mechanically by means of any power source and which comprises: [a] a receiver element that has two first edges that form a first uneven angle, from each one of which emerges a wing that can partially enclose one of said conductors; and [b] a wedge element provided with active edges that form a second angle that is essentially equal to said first angle, said wedge element being suitable for inserting between said first edges of said receiver element.

REFERENCE TO THE PRIOR ART

U.S. Pat. No. 3,848,956 describes a connector for obtaining an electrical branch from an underground conductor provided with an insulating covering, without the necessity for removing the insulation, and which provides a seal against moisture at the points where the two conductors are connected. However, the connector described is relatively difficult to install.

Also known are connectors that include a "C"-shaped sleeve and a wedge, such that the insertion of the wedge into the sleeve provides a fastening between the conductors that are to be connected, as well as an electrical connection between them, either through the sleeve or through the wedge. However, some of these connectors have disadvantages such as not being suitable for conductors with insulating covering, being difficult to assemble, and not maintaining a sufficiently secure connection.

SUMMARY OF THE INVENTION

The invention proposes to overcome the disadvantages described above. This goal is obtained with a connector of the general type described hereinbefore, but which is characterized in that it has an intermediate member that: [i] comprises electrically conductive material; [ii] is suitable for being situated between said receiver element and said wedge element and [iii] has second edges that form a third angle that is essentially equal to said first angle, while in said second edges there are individual second wings between which said wedge element can be inserted; said wings having external and opposing perforating means suitable for piercing said electrical conductors by perforating said insulating covering.

BRIEF DESCRIPTION OF THE DRAWINGS

Other advantages and characteristics of the invention will become clear from the following description which, without being in any way limiting, describes preferred embodiments of the invention, with reference to the accompanying drawings.

DETAILED DESCRIPTION OF THE INVENTION

Figure 1:
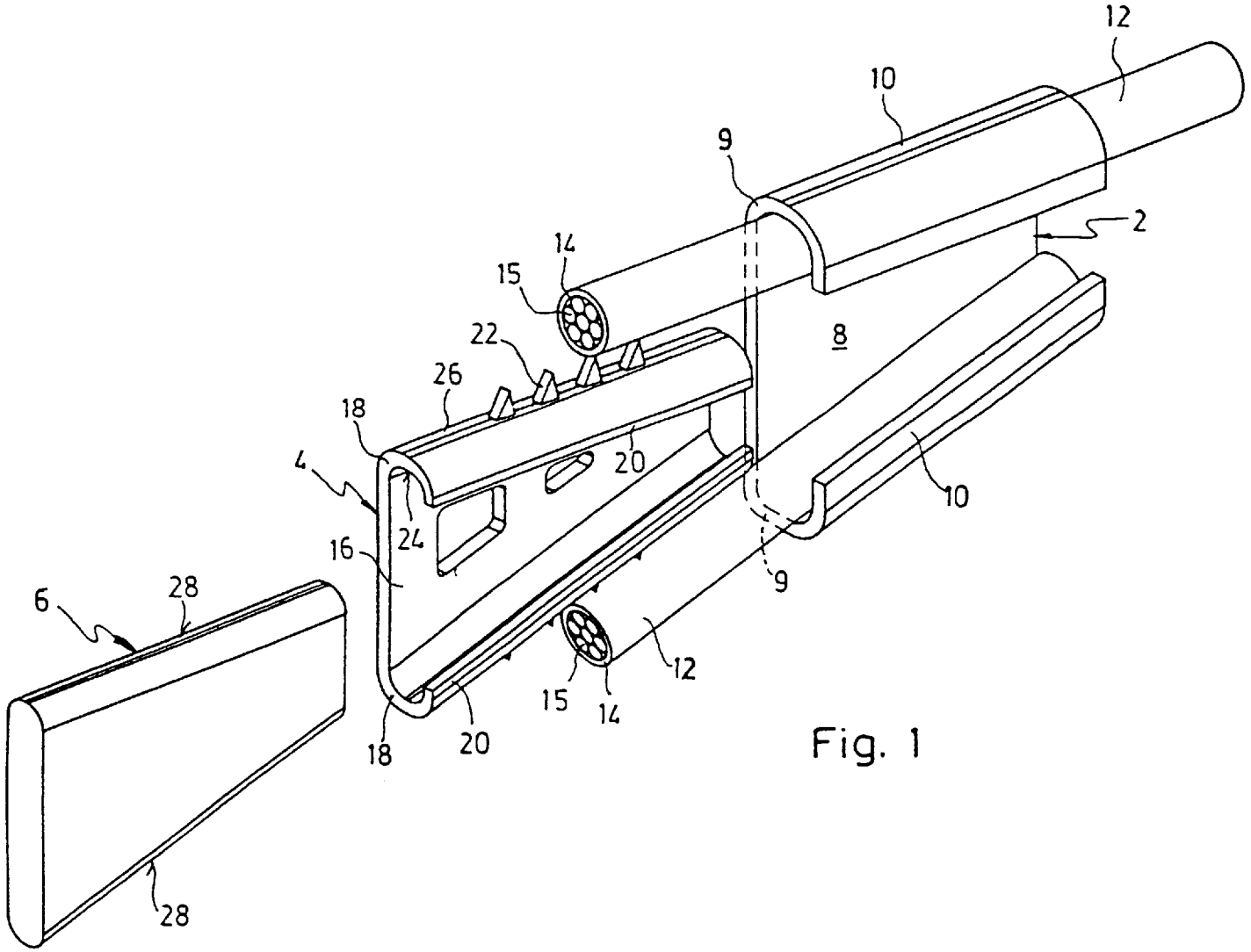
FIG. 1 is an exploded perspective view of the connector that is the object of the invention, in relation to the two conductors between which it is intended to establish a connection.

The connector comprises a receiver element 2, an intermediate member 4 and a wedge element 6.

Receiver element 2 is "C"-shaped; this means that the transverse sections of receptor element 2 would reproduce the shape of this letter "C". Receiver element 2 consists of a plate 8 limited in the longitudinal direction by two first edges 9 which form an uneven angle with one another, that is, first edges 9 are not parallel with one another. From each one of these first edges 9 emerges a first wing 10 provided with a curvature or some bends which makes them suitable so that each one of them partially encloses one of conductors 12. Each one of these conductors has an insulating covering 14 which surrounds the conductive core 15.

Intermediate member 4 also includes a plate 16 which is limited in the longitudinal direction by two second edges 18 that form a third angle between them that is essentially equal to the first angle formed by first edges 9; these second edges 18 are joined to individual second wings 20 provided with perforating means 22, which can be in the form of a series of teeth (as illustrated in FIG. 1), in the form of a blade or another shape.

The intermediate member is dimensioned so that it can be inserted into the receiver element, such that second wings 20 are applied firmly against conductors 12 and perforating means 22 can pierce insulating coating 14 to establish contact with core 15.

Each second wing 20 can have a concavity 24 facing the other second wing (FIG. 1); however, the side of each second wing 20, opposite a concavity 24 can have a flat section 26 or can have another concavity (not illustrated in FIG. 1) which facilitates its application to corresponding conductor 12. It is also provided (FIG. 2) that each second wing 20 has a concavity 25 open to the outside and within which perforating means 22 are found.

Intermediate member 4 is made of an electrically conductive material or comprises a sufficient quantity of this material to be able to connect the two conductors 12 electrically.

Wedge element 6 has two active edges 28 which form between them a second angle that is essentially equal to the first angle formed by first edges 9 of receiver element 2. This element 6 can be inserted between second wings 20 of the intermediate member and when a sufficient impulse is received, the desired adjusted application between second wings 20 and conductors 12 is produced, which establishes a connection between these conductors 12.

Figure 2:
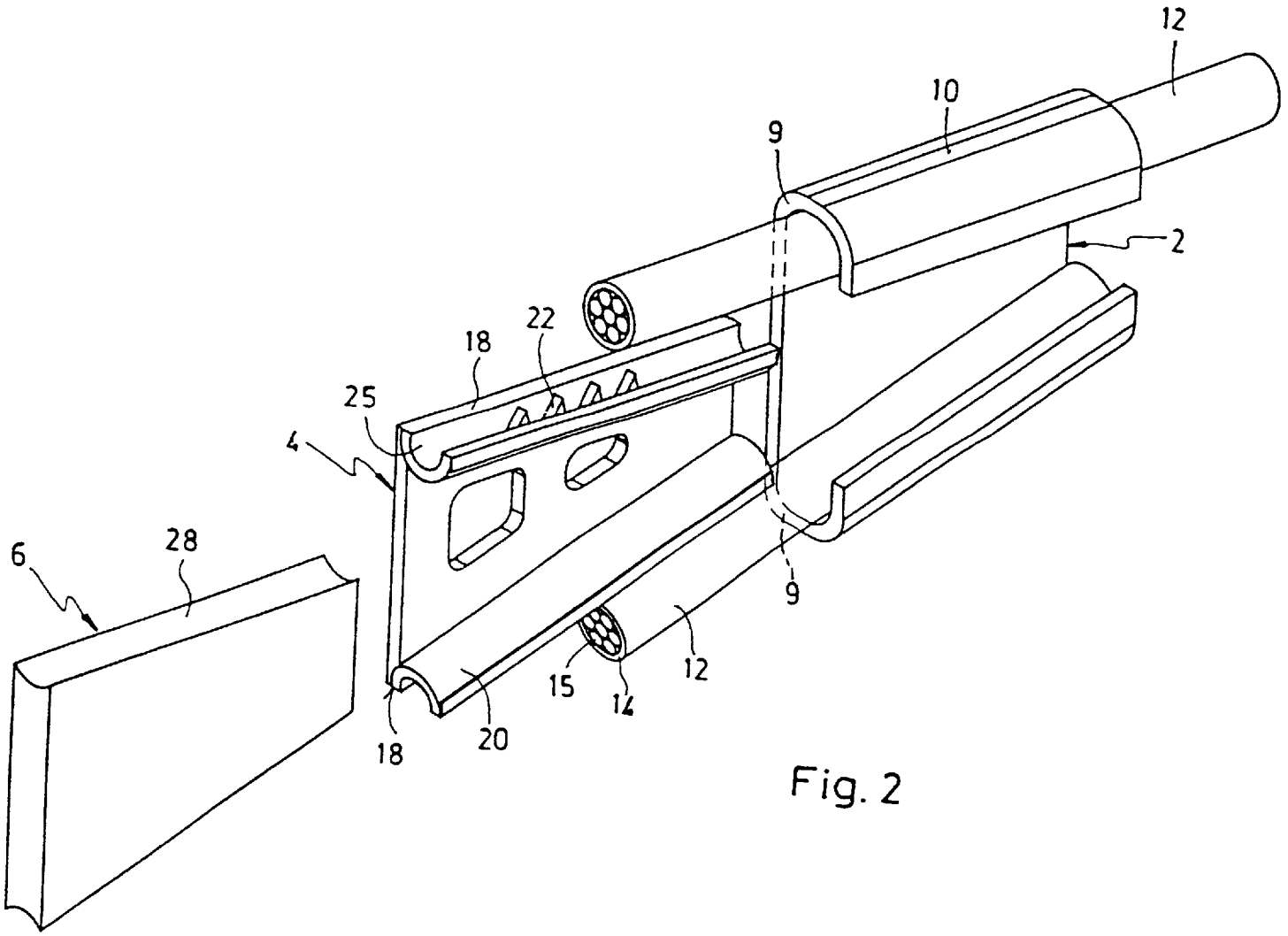
FIG. 2 is a view similar to FIG. 1, with another configuration of the second wings of the intermediate member and of the active edges of the wedge element.

When the second wings 20 have the shape illustrated in FIG. 1, it is preferable for active edges 28 to be convex, to facilitate the insertion of wedge 6 between second wings 20 provided with concavities 24. Alternatively, if the second wings 20 are such as illustrated in FIG. 2, it is preferable for active edges 28 to be concave.

Any power source is suitable for the mechanical mounting of the present connectors, such as of hydraulic origin, provided by a cartridge or any other means. Obviously, in the case of very small connectors, mounting is easily accomplished simply by using manual tools.

What is claimed is:

1. An electrical connector for connecting electrical conductors (12) provided with insulating covering (14), said connector being suitable for mounting by means of any power source and which comprises: a receiver element (2) which has first edges (9) that form a first uneven angle, from each one of which emerges a first wing (10) suitable for partially enclosing one of said conductors (12); and a wedge element (6) provided with two active edges (28) which form a second angle that is essentially equal to said first angle, said wedge element (6) being suitable for being inserted between said first edges (9) of said receiver element (2), characterized in that said connector has an intermediate member (4) which: comprises electrically conductive material; is suitable for being situated between said receiver element (2) and said wedge element (6) and has second edges (18) that form a third angle that is essentially equal to said first angle, there being in said second edges (18) individual second wings (20) between which said wedge element (6) can be inserted; said intermediate member comprising external and opposing perforating means (22) suitable for piercing said electrical conductors (12) and making electrical contact with electrically conductive cores (15) of the conductors by perforating said insulating covering (14), wherein the intermediate member (4) electrically connects the conductive cores (15) to each other.

2. The electrical connector according to claim 1, characterized in that said perforating means are made up of a series of individual teeth (22).

3. The electrical connector according to claim 1, characterized in that said active edges (28) of said wedge element (6) are convex and essentially conform to individual concavities (24) of the interior surface of said second wings (20).

4. The electrical connector according to claim 1, characterized in that said active edges (28) of said wedge element (6) are concave, and essentially conform to the individual convexities in the interior surface of said second wings (20).

5. In an electrical wedge connector having a shell with a general cross-sectional "C" shape, a wedge, and an intermediate member which receives the wedge and has conductor contact surfaces for wedging conductors against inside surfaces of the shell, wherein the improvement comprises:

the intermediate member comprising electrically conductive material and having insulation piercing teeth at the conductor contact surfaces to pierce through insulation of the conductors, electrically contact conductive cores of the conductors, and make a direct electrical connection between the conductors through the intermediate member.

6. An electrical wedge connector and electrical conductor assembly comprising:

two electrical conductors, at least one of the conductors comprising an electrically conductive core and an insulating covering;

an electrical wedge connector electrically and mechanically connecting the two conductors to each other, the wedge connector comprising a shell, a wedge and an intermediate member between the wedge and the shell, wherein the conductors are sandwiched between opposite sides of the intermediate member and the shell, wherein the wedge wedges the opposite sides of the intermediate member towards the conductors, and wherein at least one of the opposite sides of the intermediate member has insulation piercing teeth that pierce through the insulating covering of the at least one conductor and make a direct electrical connection between the intermediate member and the conductive core of the at least one conductor.

* * * * *